US011813540B2

(12) United States Patent
Cornia

(10) Patent No.: US 11,813,540 B2
(45) Date of Patent: Nov. 14, 2023

(54) GAME DEVICE AND SYSTEM

(71) Applicant: CORNIA PRODUCTIONS, INC., Los Angeles, CA (US)

(72) Inventor: Alessandro Cornia, Los Angeles, CA (US)

(73) Assignee: CORNIA PRODUCTIONS, INC., Los Angeles, CA (US)

( * ) Notice: Subject to any disclaimer, the term of this patent is extended or adjusted under 35 U.S.C. 154(b) by 46 days.

(21) Appl. No.: 17/590,136

(22) Filed: Feb. 1, 2022

(65) Prior Publication Data

US 2022/0241679 A1 Aug. 4, 2022

Related U.S. Application Data

(60) Provisional application No. 63/144,351, filed on Feb. 1, 2021.

(51) Int. Cl.
*A63F 9/08* (2006.01)

(52) U.S. Cl.
CPC ..... *A63F 9/0834* (2013.01)

(58) Field of Classification Search
CPC ..... A63F 9/0834; A63F 2250/144; A63F 2250/24; A63F 9/0826
See application file for complete search history.

(56) References Cited

U.S. PATENT DOCUMENTS

| | | | | |
|---|---|---|---|---|
| 8,651,487 | B2 * | 2/2014 | Holmes | A63F 9/08 70/289 |
| 11,484,780 | B1 * | 11/2022 | Jiang | A63F 9/34 |
| 2009/0127783 | A1 * | 5/2009 | Paquette | A63F 9/0834 273/153 S |

FOREIGN PATENT DOCUMENTS

| | | | | | |
|---|---|---|---|---|---|
| CN | 111643884 | A | * | 9/2020 | A63F 9/0612 |
| CN | 114669038 | A | * | 6/2022 | |
| GB | 2090749 | A | * | 7/1982 | A63F 9/0834 |
| GB | 2493548 | A | * | 2/2013 | A63F 9/0834 |
| JP | 2013017807 | A | * | 1/2013 | |

* cited by examiner

*Primary Examiner* — Steven B Wong
(74) *Attorney, Agent, or Firm* — Concept IP LLP; Pejman Yedidsion

(57) ABSTRACT

Systems, devices, and methods for a system for a 3-D combination puzzle cube. A game device may include: an outer shell defining a set of guide channels, an inner shell housed within the outer shell, a tumbler system housed within the inner shell, and a set of cube components configured to slide across the set of guide channels, where the set of cube components are arranged to form a 3×3×3 cube, and where at least four cube components on each side of the formed 3×3×3 cube have an imprinted chess piece.

20 Claims, 24 Drawing Sheets

412

GAME DEVICE AND SYSTEM

CROSS-REFERENCE TO RELATED APPLICATIONS

This application claims priority to and the benefit of U.S. Provisional Patent Application No. 63/144,351, filed Feb. 1, 2021, the contents of which are hereby incorporated by reference herein for all purposes.

TECHNICAL FIELD

The embodiments herein relate generally to devices that are used in games.

BACKGROUND

Combination puzzles involve moving sections of the puzzle so that each side of the puzzle has a desired color, shape, or pattern. Combination puzzles may include multiple sections that may rotate independently from other sections of the puzzle.

SUMMARY

A game device is configured to enable human users to play chess on a combination puzzle. The game device has a colorless combination puzzle cube having nine squares on each side of a six-sided cube. A plurality of chess pieces and/or chess piece designs may be arranged on the nine squares on each side of the six-sided cube forming a puzzle. Rotating the sides of the six-sided cube enables a user to form a checkmate on each side and solve the puzzle A game device may include: an outer shell defining a set of guide channels, an inner shell housed within the outer shell, a tumbler system housed within the inner shell, and a set of cube components configured to slide across the set of guide channels, where the set of cube components are arranged to form a 3×3×3 cube, and where at least four cube components on each side of the formed 3×3×3 cube have an imprinted chess piece and/or chess design.

BRIEF DESCRIPTION OF THE DRAWINGS

The components in the figures are not necessarily to scale, emphasis instead being placed upon illustrating the principals of the invention. Like reference numerals designate corresponding parts throughout the different views. Embodiments are illustrated by way of example and not limitation in the figures of the accompanying drawings, in which.

DETAILED DESCRIPTION

Figure 1:
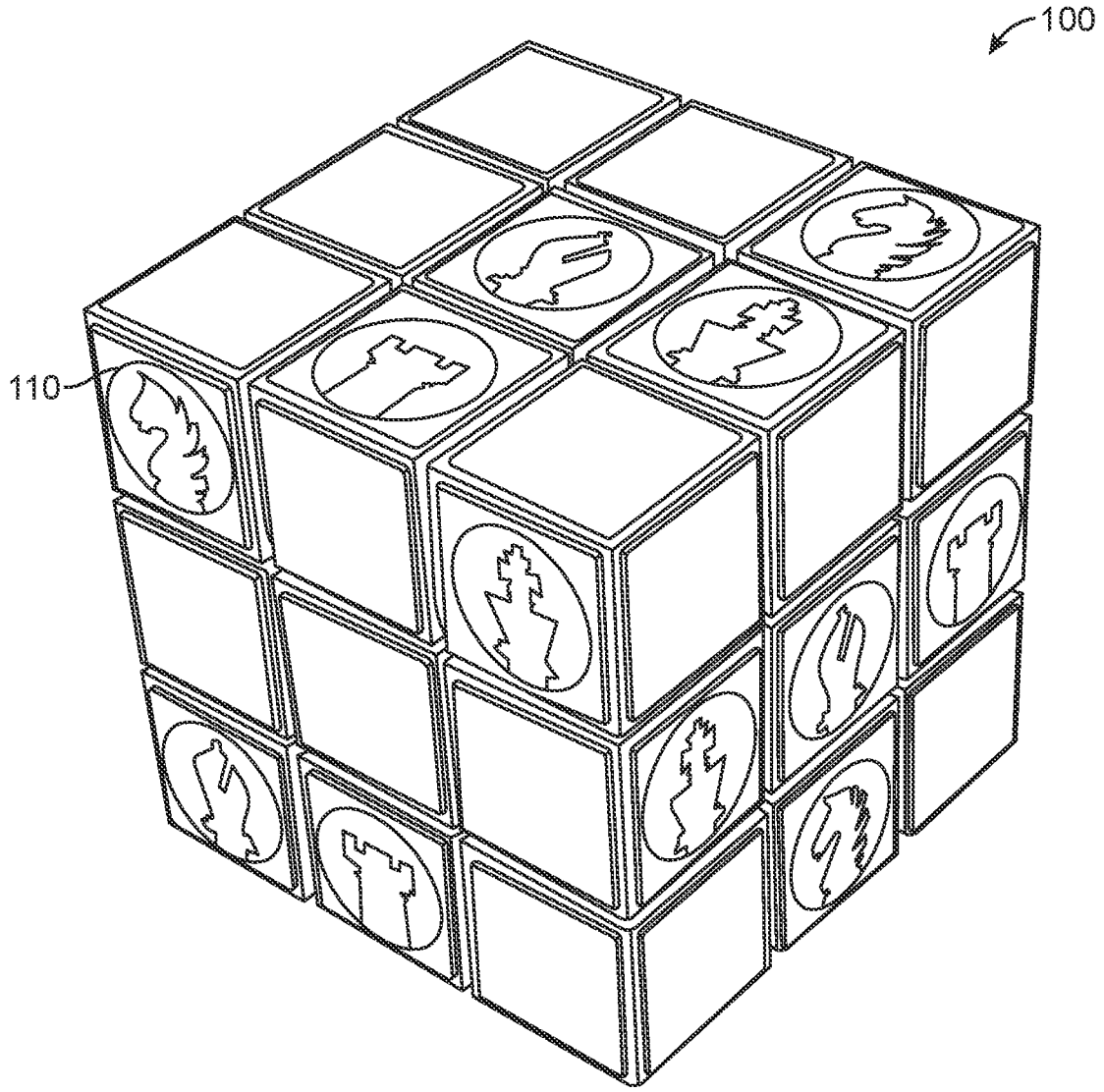
FIG. 1 depicts the game device with a chess pattern, according to an embodiment of the disclosure.

The game device allows for the solving of the chess puzzles in a three dimensional manner. In one embodiment, solving the chess puzzle may cause the game device to automatically disassemble to allow a user to access a reward within the game device. In one embodiment, the game device may require a specific solution to be unlocked for automatic disassembly. In one embodiment, the game device may use a tumbler system to prevent the user from manually disassembling the game device. In one embodiment, the tumbler system may utilize one or more pin tumbler locks.

The disclosed game device utilizes six games of chess on the six faces of the 3×3 squares of a colorless combination puzzle. The game device is configured to open once all of the 26 "cube components" are in the correct position, i.e., all the 6 Kings on each of the 6 faces are under checkmate. The chess game is reduced and limited by the 3×3 boards of the combination puzzle cube faces, making impossible a straight forward implementation of the game of chess into a combination puzzle. It works with the King, Rook, Knight and Bishop pieces used, and those pieces only, i.e., four per face. It won't work if the rest of the chess pieces are included, or more or less than 4 pieces are used. The game device utilizes a series of lined-up tumbler pins into an orbicular application where twenty-six tumbler pins are precisely positioned around a sphere (the inner core of the combination puzzle), to interact with all the 26 "cube components" that make the disclosed game device.

By way of example, one embodiment of a game device is configured to enable human users to play chess on a combination puzzle. The game device has a colorless combination puzzle cube having nine squares on each side of a six-sided cube. A plurality of chess pieces are arranged on the nine squares on each side of the six-sided cube forming a puzzle. Rotating the sides of the six-sided cube enables a user to form a checkmate on each side and solve the puzzle. The chess pieces may be physical pieces in some embodiments. In other embodiments, the chess pieces may be designs affixed to each side of the cube. In some embodiments, the chess pieces may be detachably attached. In other embodiments, the chess pieces may be fixedly attached. The squares on the combination puzzle may contain a chess piece or may be blank. The blank sides of the combination puzzle may indicate an open spot on a chess board.

The game device may comprise a color-less, white, or solid-colored combination puzzle and elements of the game of chess. The game is solved when on every face of the cube, the chess King is in checkmate. The combination puzzle has 9 squares on each face (3×3). A solved game has each face of the cube with one square occupied by the King and 3 other chess pieces (Rook, Knight, and Bishop) who are in some way checkmating the King, obeying the regular rules of the game of chess, using a 3×3 board (the combination puzzle's cube face) instead of a 8×8 square chess board. The player moves the in-square chess pieces according to the dynamics of the combination puzzle. Only King, Rook, Knight and Bishop chess pieces may be used. Other pieces may not be included in the game. It is possible and contemplated that other pieces may be used in alternate embodiments.

FIG. 1 depicts the game device 100 having a chess pattern 110, according to an embodiment of the disclosure. In some embodiments, the chess pattern 110 may be configured to simulate a chess puzzle. For example, the chess pattern 110 may be a chess puzzle involving checkmating the king using a rook, a knight, and a bishop.

Figure 2:
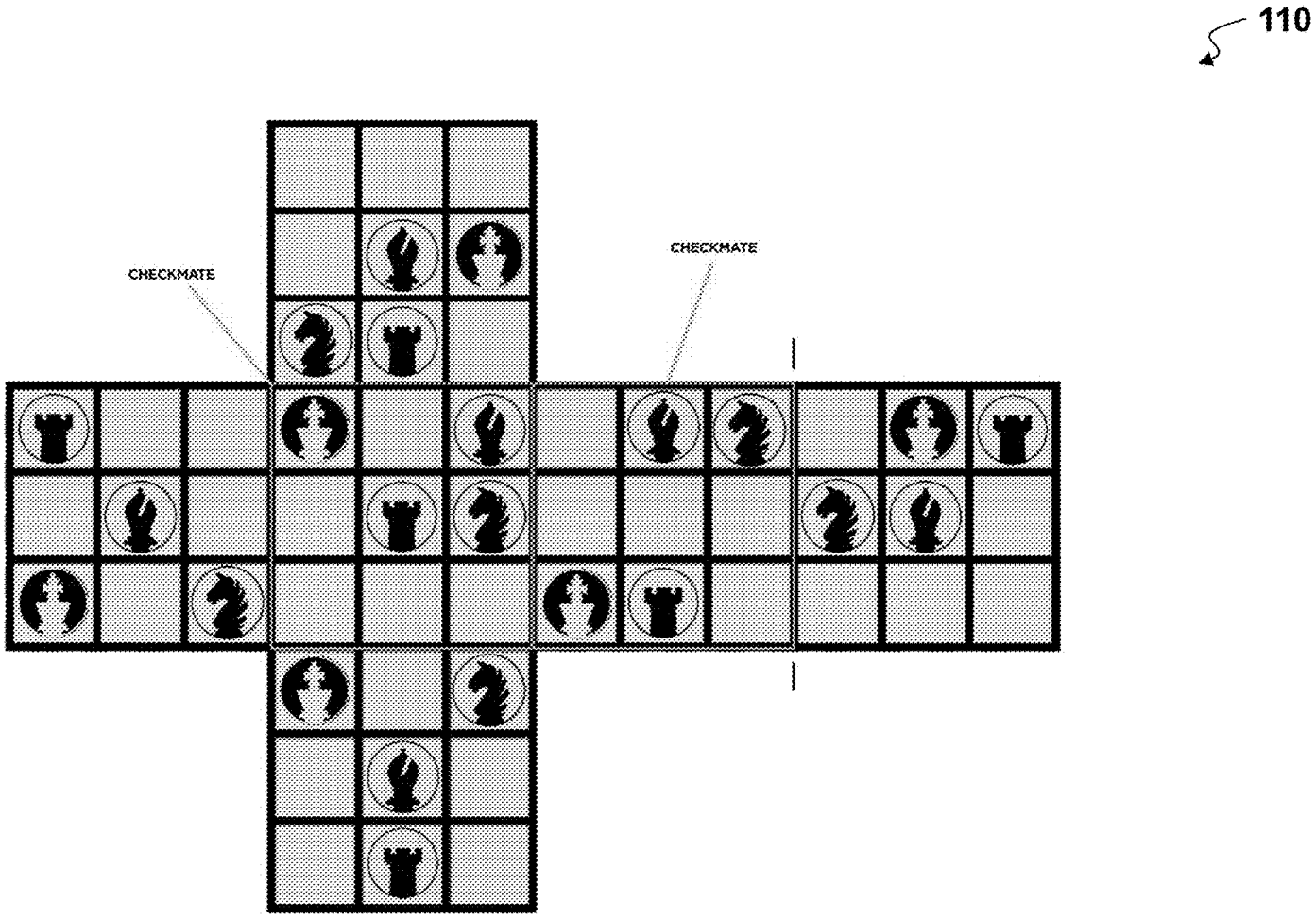
FIG. 2 depicts a 2-D view of a chess pattern, according to an embodiment of the disclosure.

FIG. 2 depicts a 2-D view of a chess pattern 110 that may be applied to a 3-D combination puzzle cube, according to an embodiment of the disclosure. In some embodiments, the chess pattern 110 may have a total of six chess puzzles with one chess puzzle for each side of the combination puzzle cube. In some embodiments, one or more sides may not have a solution such as one side out of six not containing a king.

Figure 3B:
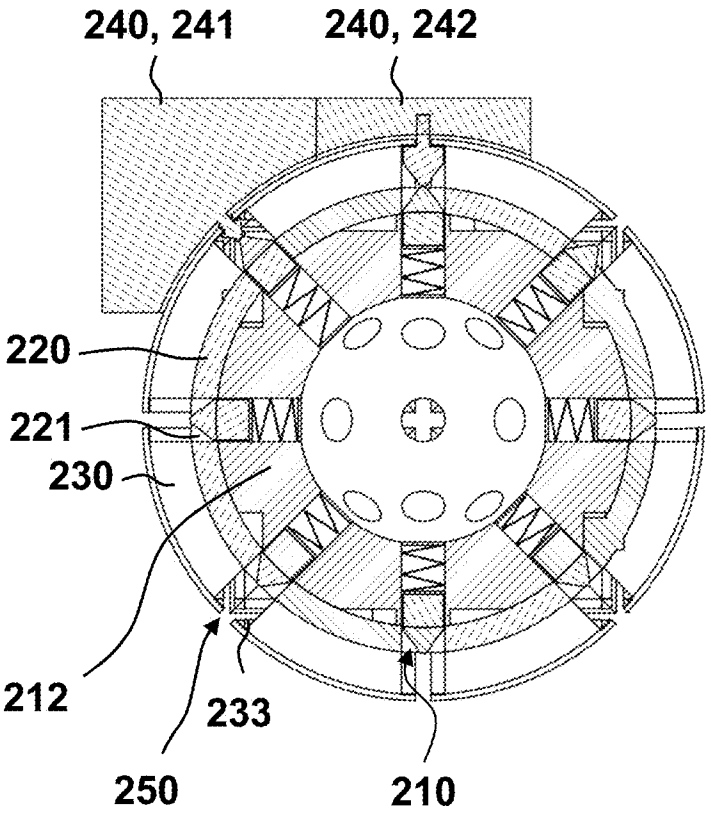
FIG. 3B depicts a cross-section of FIG. 1 along the line A-A of FIG. 3A, according to an embodiment of the disclosure.
Figure 3A:
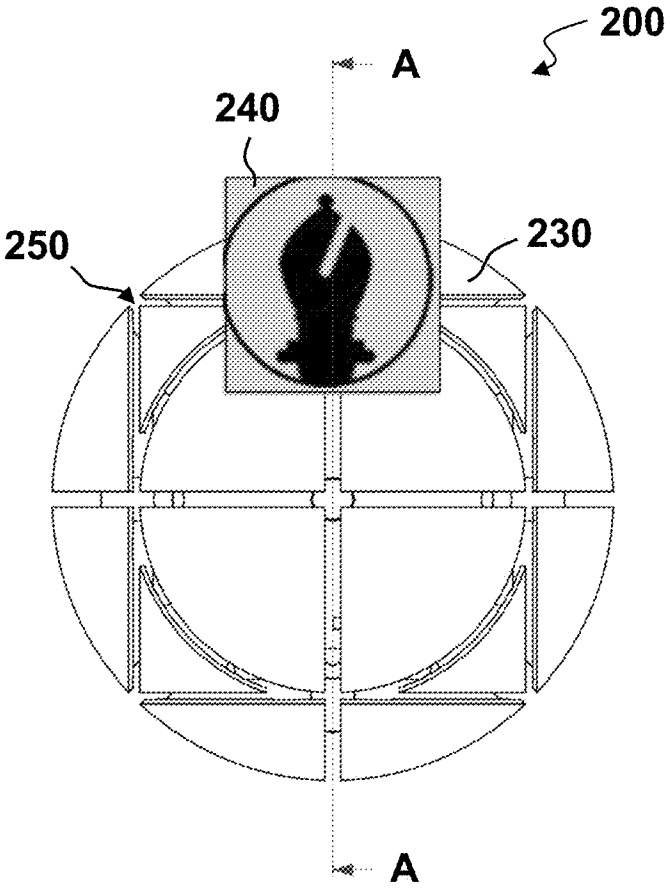
FIG. 3A depicts a side view of the present game device, according to an embodiment of the disclosure.

FIG. 3A depicts a side view of a game device 200, according to an embodiment of the disclosure. The game device 200 may include an outer shell 230 with a set of guide channels 250 to receive cube components 240. In some embodiments, the guide channels 250 are the same width. The cube components 240 may be arranged to form a 3×3×3 cube. The cube components 240 may move across the set of guide channels 250 as part of a combination puzzle cube to move from one side of the cube to another of the five sides of the cube. In one embodiment, at least four cube components 240 on each face of the 3×3×3 cube may have a chess piece. In one embodiment, the chess pieces on the at least four cube components 240 may be a king, a rook, a knight, and a bishop. In some embodiments, the outer shell 230 may combine with another outer shell 230 to form an encapsulating cover. The outer shell 230 and the inner shell 220 may be one piece in one embodiment.

Figure 8:
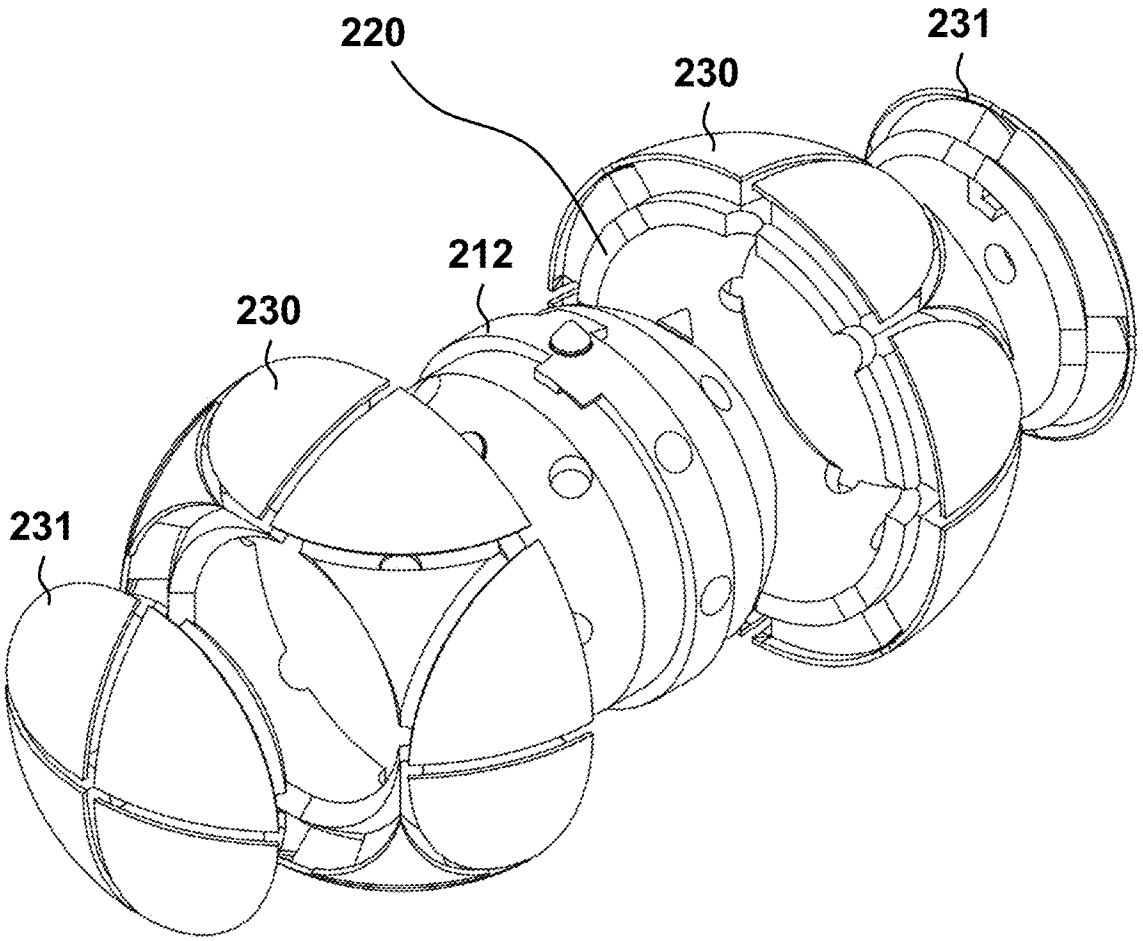
FIG. 8 depicts an exploded view of the outer shell, inner shell, and tumbler system, according to an embodiment of the disclosure.

FIG. 3B depicts a cross-section of FIG. 3A along the line A-A, according to an embodiment of the disclosure. The interior of 230 is illustrated to indicate a hollow portion made by the channels/guides, which may not be a different part. The outer shell 230 and the inner shell 220 may be made as one piece, as shown in FIG. 8. The inner shell 220 may house a tumbler system 210 that may be rotationally locked to the inner shell 220 to prevent the inner shell 220 from rotating in one direction. The tumbler system 210 may include a tumbler core 212 that is rotationally locked to the inner shell 220 to prevent the inner shell 220 from rotating in a different non-desired direction. The outer shell 230 may have one or more stoppers 231 disposed proximate the guide channels 250 to prevent parts of the tumbler system 210 from exiting the guide channels 250. Cube components 240 such edge cube component 241 and middle cube component 242 may engage the outer shell 230. In some embodiments, there may be twenty-six cube components engaging the outer shell. In some embodiments, latch springs may be used to push the inner shell 220 and outer 230 shell away from each other.

Figure 3C:
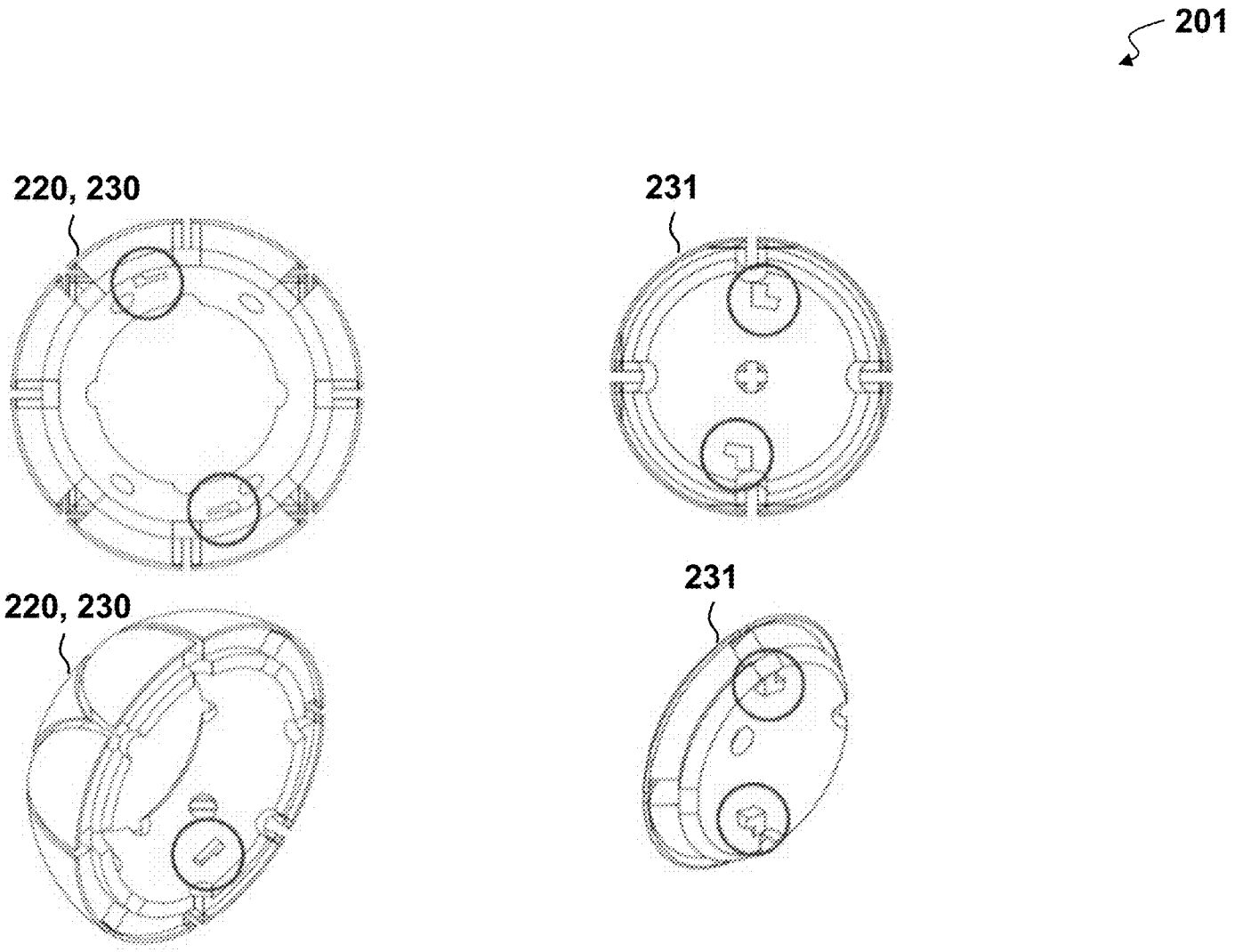
FIG. 3C depicts latch positions on outer shells, according to an embodiment of the disclosure.

FIG. 3C depicts latch positions on outer shells 201. The latches are shown within circles. The emispheres include the outer shell 230 and inner shell 220, which may be one piece. The poles are the outer shell ends 231.

Figure 3D:
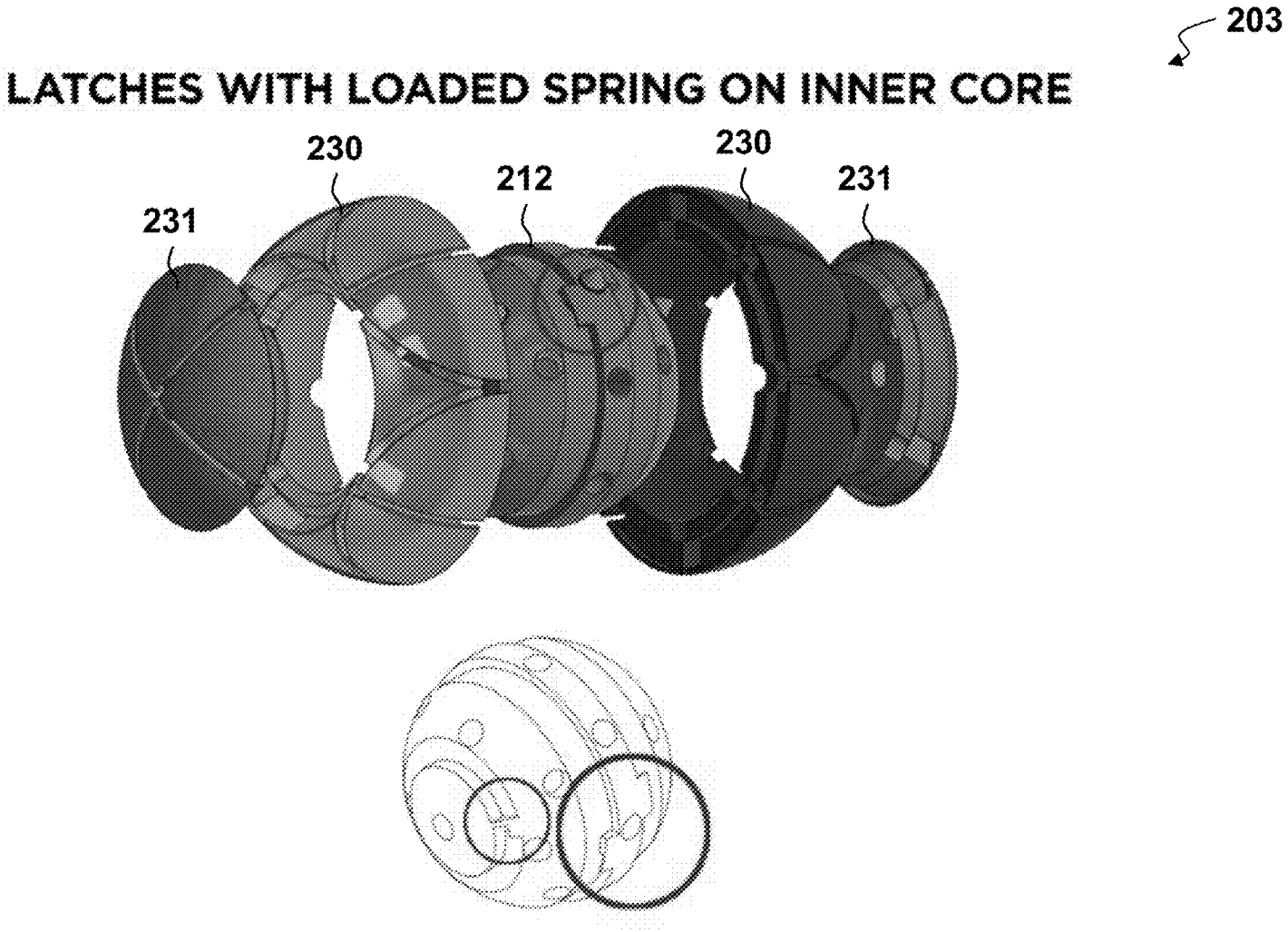
FIG. 3D depicts latches with loaded spring on inner core, according to an embodiment of the disclosure.

FIG. 3D depicts latches with loaded spring on inner core 203. FIG. 3D depicts an exploded view of the outer shell 230, outer shell end 231, and tumbler core 212, according to an embodiment of the disclosure. The outer shell is made of 4 separate parts. Two pieces 231 at the poles and two pieces 230 that form the two center hemispheres. The very center of the tumbler core 212 may be hollow in some embodiments to store the reward. The walls of the core may be thick, because that is where the springs for the tumbler pins are set. The outer shells 230 and the core 212 are locked together by latches (such as hooks) positioned alongside the latching ridges of the core 212. Inside the latches may be preloaded springs that generate a constant push for the outer shell 230 to rotate around the core 212, in effect dismantling the whole combination puzzle cube. What prevents the two sections from rotating are the tumbler pins that slide through shafts that run under every cube face. All the tumbler pins must be aligned with the shear line (where the core touches the outer shell) for the springs inside the latching to be able to engage.

Figure 4A:
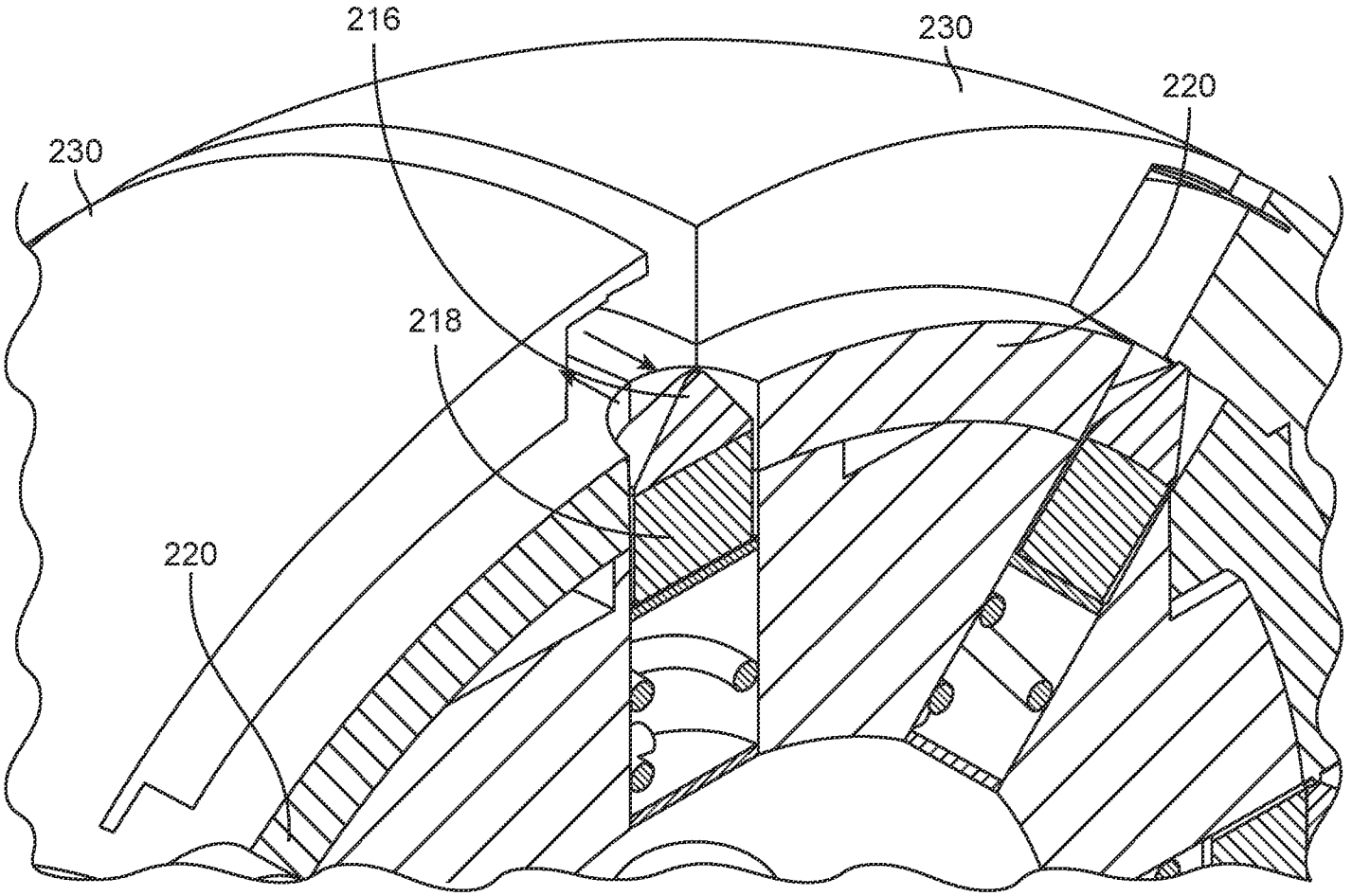
FIG. 4A depicts a close-up view of an upper tumbler pin preventing the shells from rotating, according to an embodiment of the disclosure.

FIG. 4A depicts a close-up view of an upper tumbler pin 216 preventing the shells from rotating, according to an embodiment of the disclosure. The upper tumbler pin 216 may be positioned adjacent to a lower tumbler pin 218. The pins below every face of the cube are key pins. The pins are encased in a shaft that starts from the core and goes through aligned shafts in the outer shell. They are pushed together by the spring underneath against the "key pin" (FIG. 6, 2401) from under the cube face or the "shaft collar" when the cube faces are rotating. The two driver pins separate when the lower pin tumbler 216 line up with the shear line (where the core 212 and outer shell 220,230 touch), leaving the upper tumbler 218 inside the outer shell. The upper tumbler pin 216 prevents both outer shells 230 and inner shells 220 from rotating. The outer shells 230 and inner shells 220 may be one piece in some embodiments.

Figure 4B:
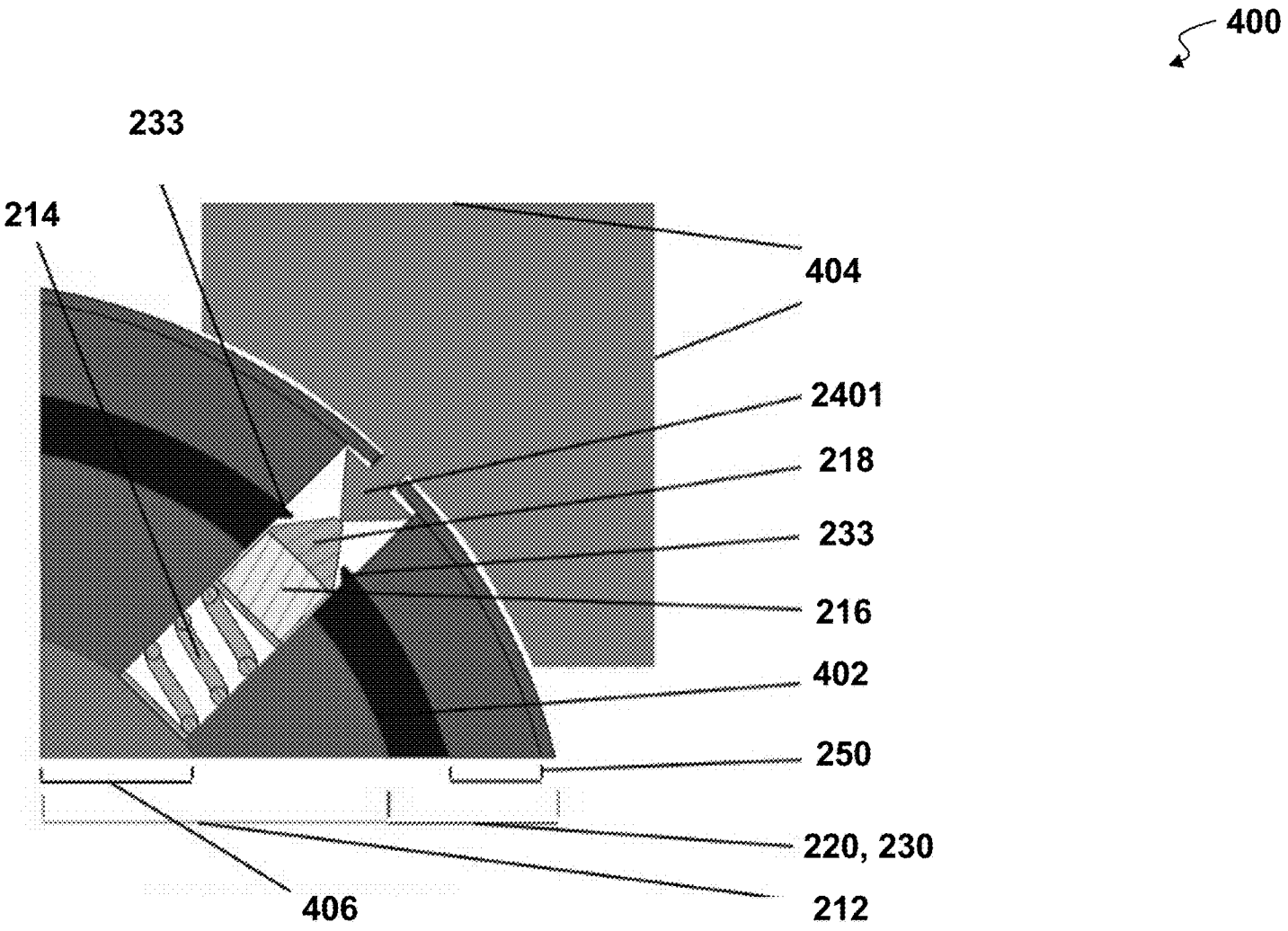
FIG. 4B depicts a cross section of a pin tumbler mechanism, according to an embodiment of the disclosure.

FIG. 4B depicts a cross section of a portion of a pin tumbler mechanism 400, according to an embodiment of the disclosure. The mechanism 400 includes a spring 214, a collar or ledge 233, cube faces 404, a cube pin or key pin 2401, an upper pin or driver pin 218, a lower pin or driver pin 216, a shear line 402, a channel guide for cube pins 250, an outer shell 220, 230, a core 212, and a hollow center core 406. There are 26 "cube components" configured to slide across the set of guides. There may be a tumbler pin for each cube component, so there may be 26 pin tumbler mechanisms 400 in each game device.

Figure 4C:
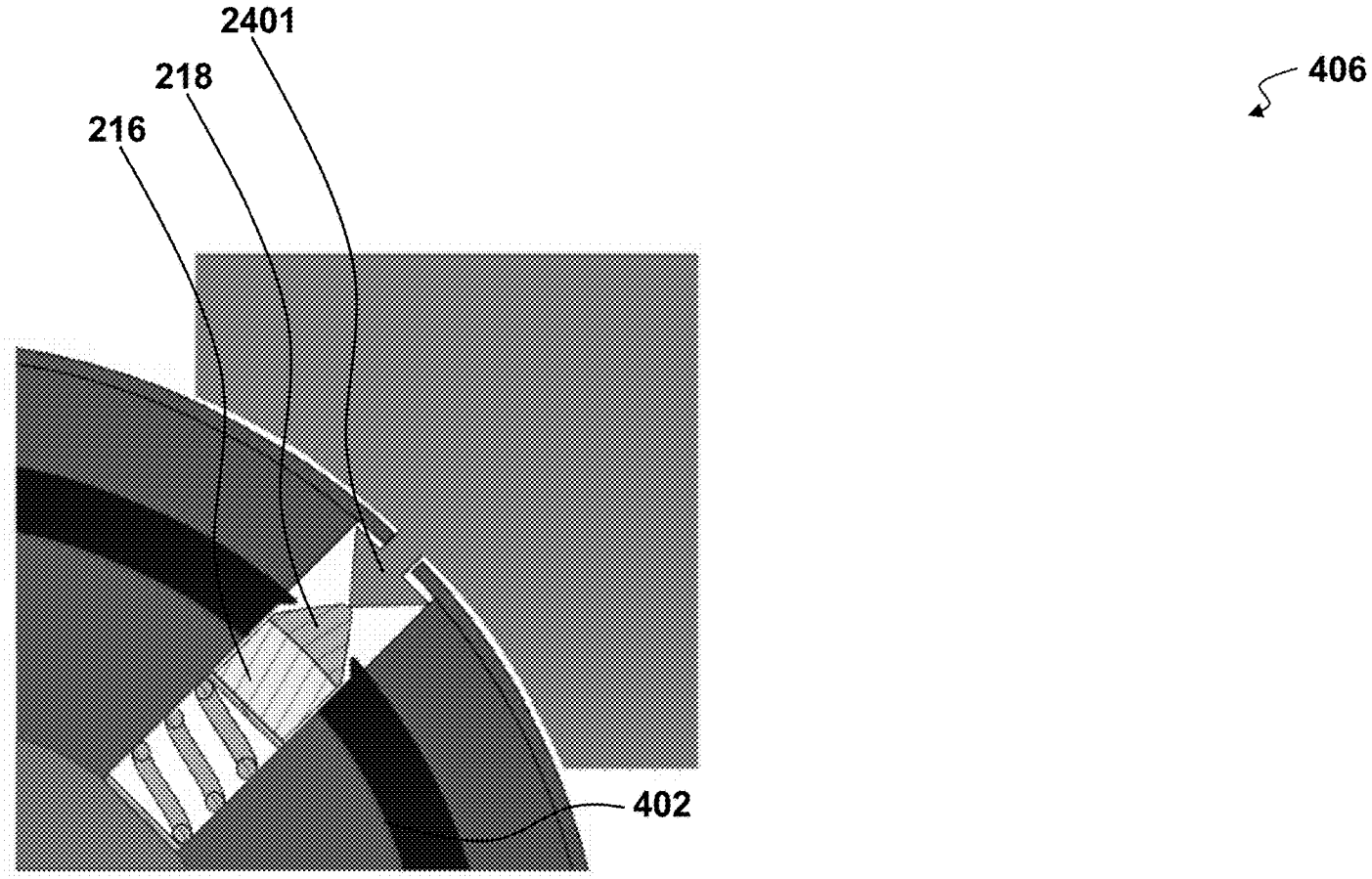
FIG. 4C depicts a cross section of the pin tumbler mechanism in FIG. 4B with the cube face in a wrong position, according to an embodiment of the disclosure.

FIG. 4C depicts a cross section of the pin tumbler mechanism in FIG. 4B with the cube face in a wrong position 406, according to an embodiment of the disclosure. As a result of the size of the cube pin or key 2401, the upper pin 218 and lower pin 218 are not aligned so that they intersect at the shear line 402.

Figure 4D:
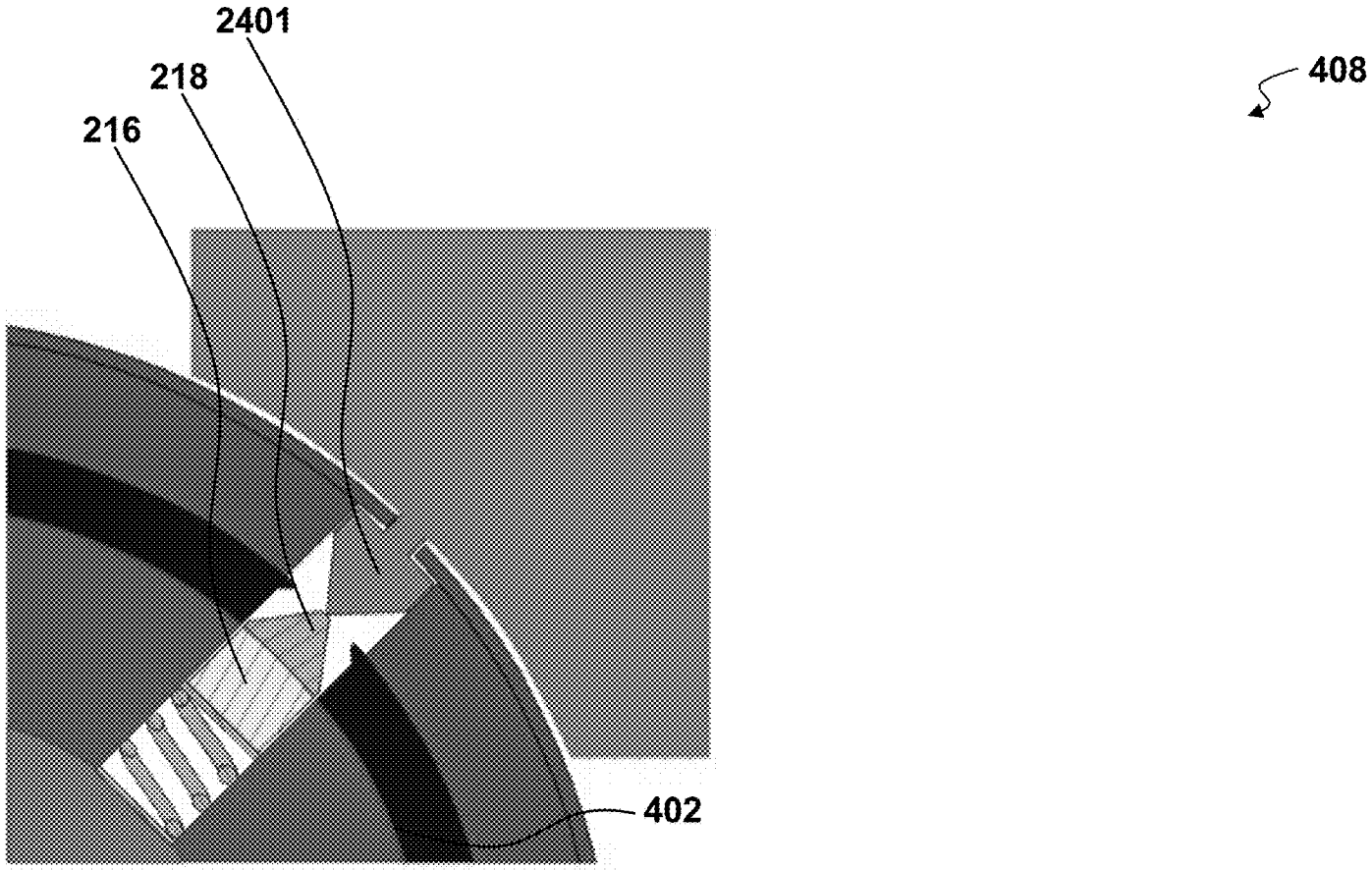
FIG. 4D depicts a cross section of the pin tumbler mechanism in FIG. 4B with the cube face in a correct position, according to an embodiment of the disclosure.

FIG. 4D depicts a cross section of the pin tumbler mechanism in FIG. 4B with the cube face in a correct position 408, according to an embodiment of the disclosure. As a result of the size of the cube pin or key 2401, the upper pin 218 and lower pin 218 are aligned so that they intersect at the shear line 402. For each correct position, the length of the cube pin 2401 and upper tumbler pin 218 may vary. This variation in cube pin 2401 and upper tumbler pin 218 length and/or size is used to generate enough variants to create the unique scenario where each cube pin 2401 matches with only one corresponding upper tumbler pin 218.

Figure 4E:
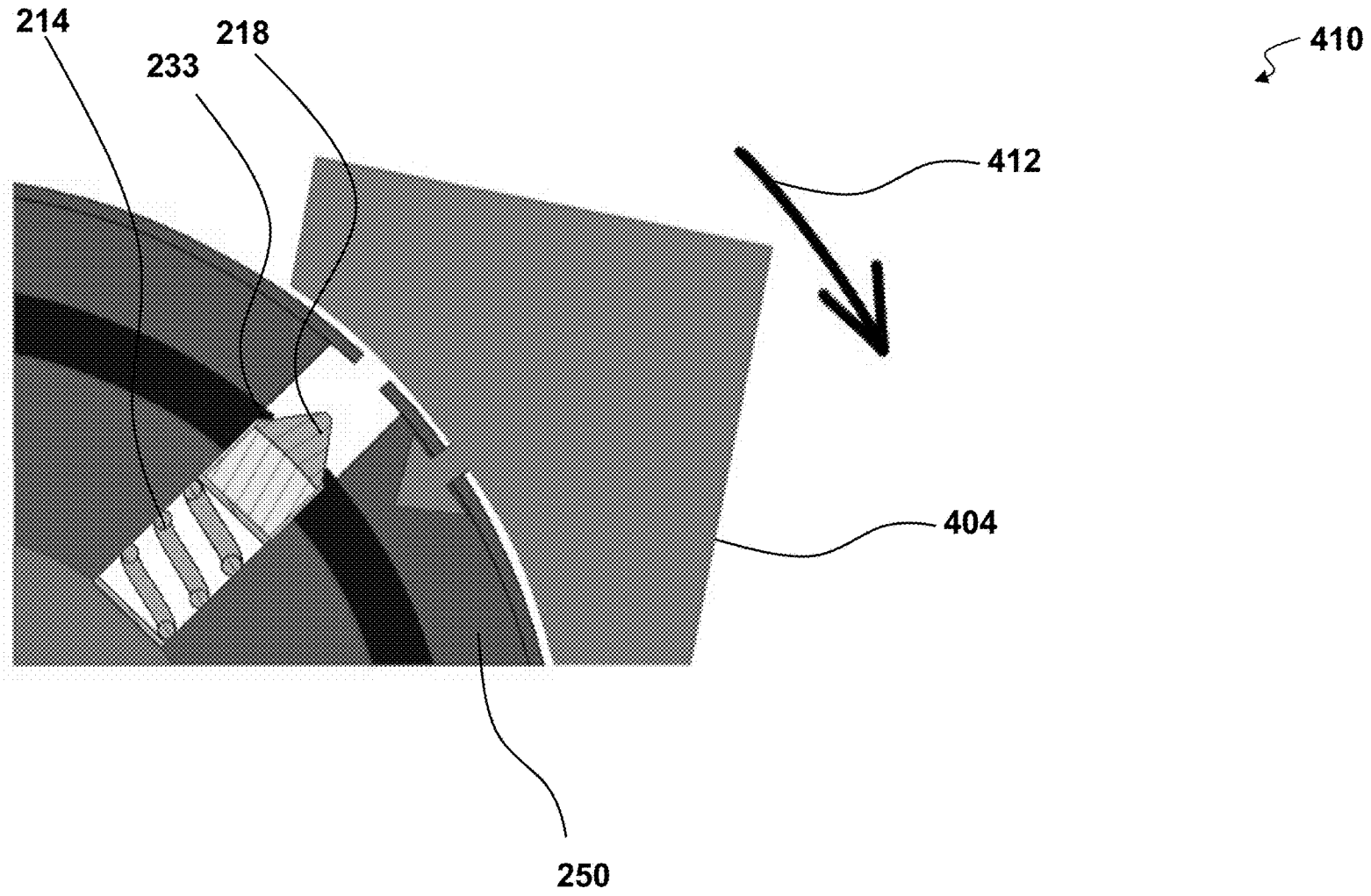
FIG. 4E depicts a cross section of the pin tumbler mechanism in FIG. 4B with the cube face in transition between positions, according to an embodiment of the disclosure.

FIG. 4E depicts a cross section of the pin tumbler mechanism in FIG. 4B with the cube face in transition between positions 410, according to an embodiment of the disclosure. As the cube face 404 is being rotated 412, the spring 214 inside the shaft pushes the pins up until the upper pin 218 rests against the collar 233, keeping the mechanism from escaping the shaft into the channel guides.

Figure 4F:
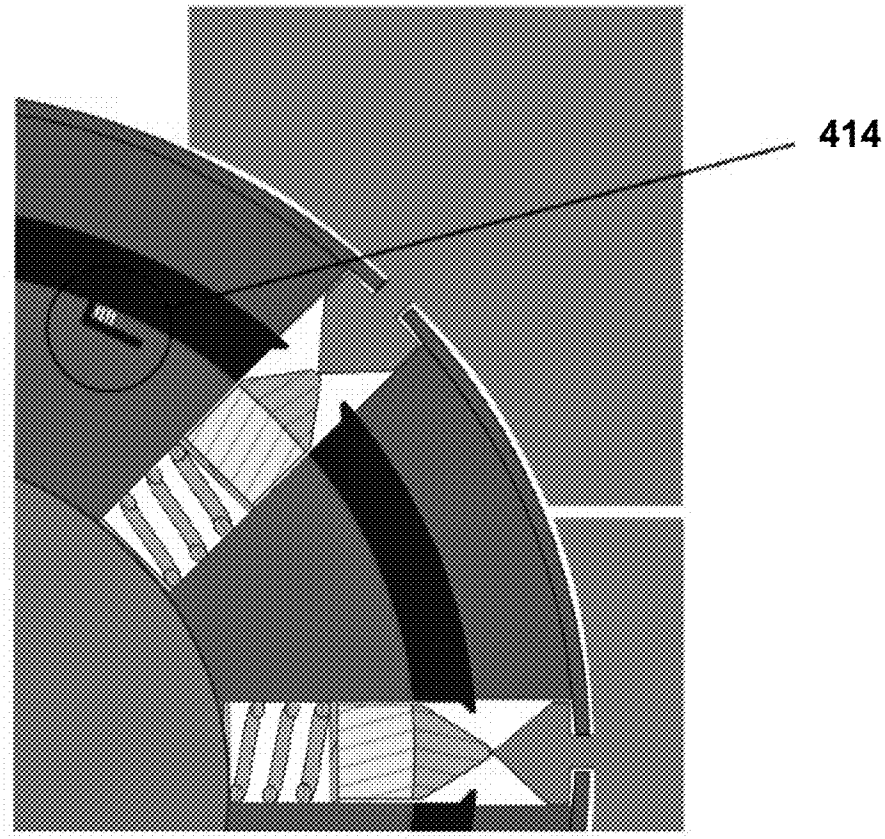
FIG. 4F depicts a cross section of the pin tumbler mechanism in FIG. 4B with all the cube faces in their correct positions, according to an embodiment of the disclosure.

FIG. 4F depicts a cross section of the pin tumbler mechanism in FIG. 4B with all the cube faces in their correct positions 412, according to an embodiment of the disclosure. A latch with loaded spring 414 may be used to separate all the outer shells from the inner core to disassemble the present game device.

Figure 4G:
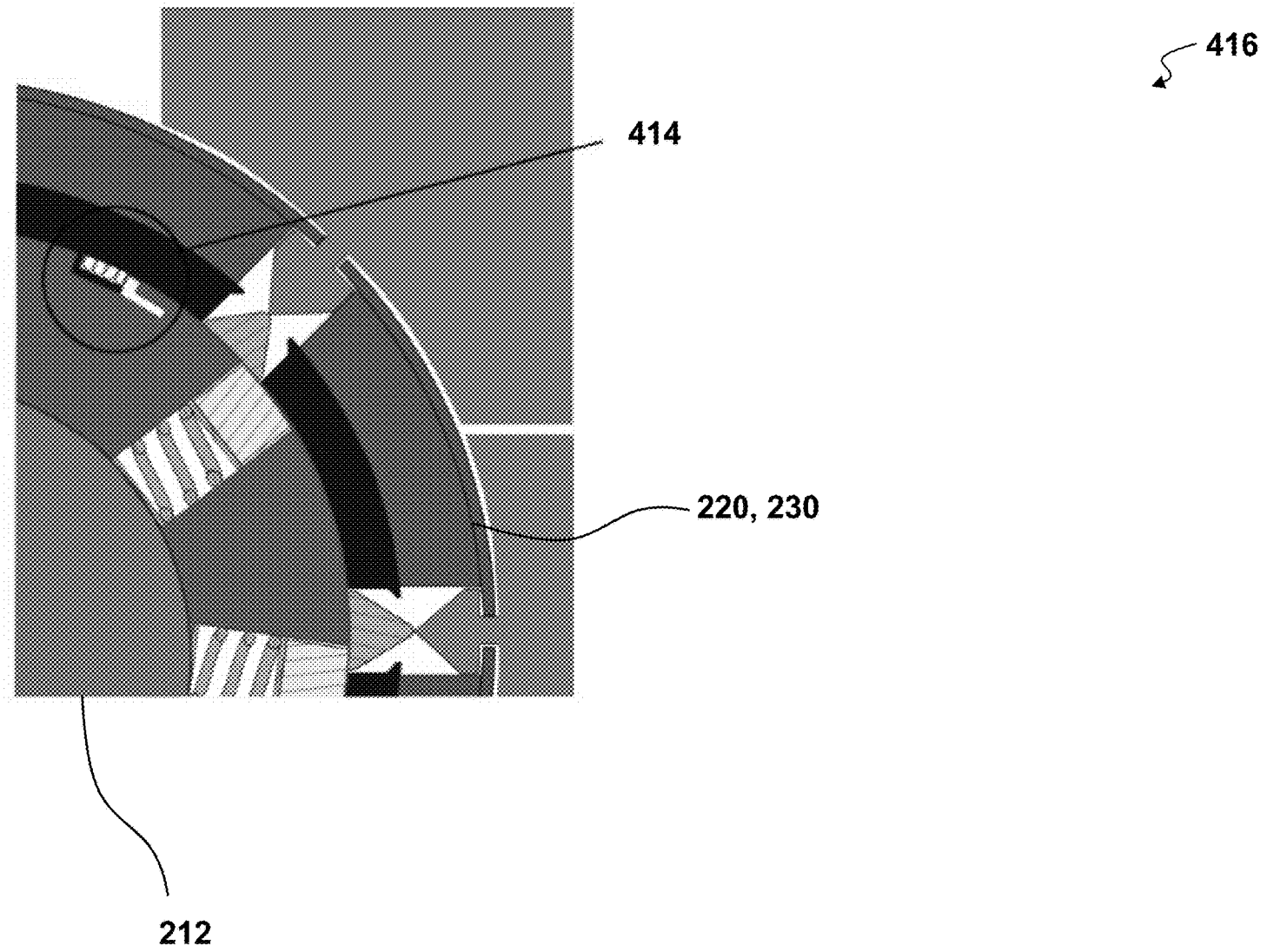
FIG. 4G depicts a cross section of the pin tumbler mechanism in FIG. 4B with latches that separate all the outer shells from the inner core to disassemble the present game device, according to an embodiment of the disclosure.

FIG. 4G depicts a cross section of the pin tumbler mechanism in FIG. 4B with latches that separate all the outer shells from the inner core to disassemble the present game device 416, according to an embodiment of the disclosure. The outer shells 220, 230 are locked with the inner core 212 by a series of catch latches 414. Inside the latches 414 may be preloaded springs. Once all the tumbler pins are aligned with the shear line, the outer shells 220, 230 are free to rotate against the inner core 212. The springs in the latches 414 expand and separate all the outer shells 220, 230 from the inner core 212, which disassembles the whole game device.

Figure 5:
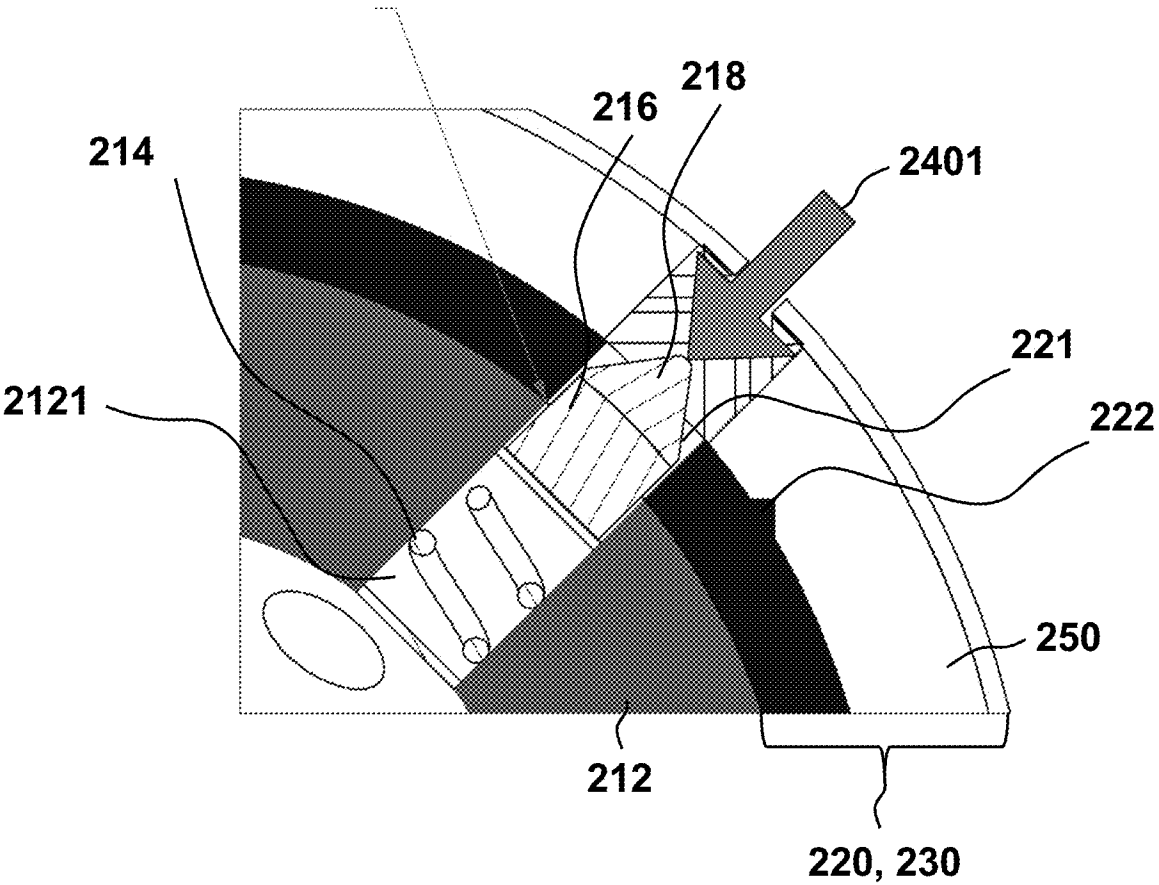
FIG. 5 depicts a close-up view of the upper tumbler pin engaging the pin of a cube component, according to an embodiment of the disclosure.

FIG. 5 depicts a close-up view of the upper tumbler pin 216 engaging the pin 2401 of a cube component 240, according to an embodiment of the disclosure. Section 250 shows the channel guide carved out from the outer shell 220, 230. The upper tumbler pin 218 and the lower tumbler pin 216 may be pushed into cube pin or key pin 2401 by a compression mechanism 214 such as a spring. Other mechanisms for limiting movement in desired directions are possible and contemplated. The compression mechanism 214 may be housed within a member of a set of tumbler channels 2121 within the tumbler core. The inner shell 220 may be prevented from rotationally disengaging the outer shell 230 by the upper tumbler pin 218. The inner shell 220 may rotationally disengage from the outer shell 230 by having the cube component pin 2401 push the upper tumbler pin 218 and lower tumbler pin 216 into the inner channel 221 such that the upper pin 218 and lower pin 216 line up with a shear line (402, FIG. 4B). The lower tumbler pin 216 may be thicker than the inner shell 220 in some embodiments. The cube pin 2401 needs to push the tumbler pins 216, 218 down enough for the lower tumbler pin 216 to be completely encased inside the core 212. Since the cube pins may have different depths the upper tumbler pins 218 also need to be different in height, for the disclosed tumbler lock system. The combination of different heights for the tumbler pins 216, 218 and the cube pins 2401 will determine which cube pin 2401 aligns the lower pin 216 exactly inside the core and with the shear line (402, FIG. 4B). Accordingly, the respective lower pins 216 will be aligned with the shear line (402, FIG. 4B) when the combination puzzle is in the correct orientation on all faces, i.e., the combination puzzle has been 'solved'.

In some embodiments, the tumbler system 212 may employ a system utilizing portions of a pin tumbler lock. For example, upper tumbler pin 216 and lower tumbler pin 218 may be configured to have different configurations to ensure each set of tumbler pins 216, 218 require a unique cube pin. The pins may 'bob' up and down when the cube faces are rotated.

Figure 6:
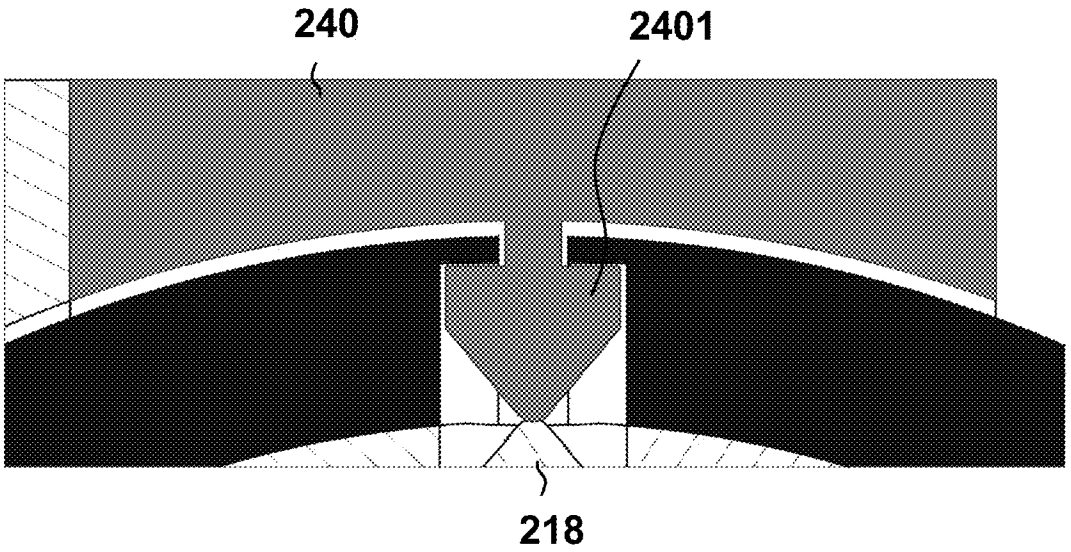
FIG. 6 depicts a close-up view of the upper tumbler pin engaging the pin of a cube component, according to an embodiment of the disclosure.

FIG. 6 depicts a close-up view of the upper tumbler pin 218 engaging the pin 2401 of a cube component 240, according to an embodiment of the disclosure.

Figure 7:
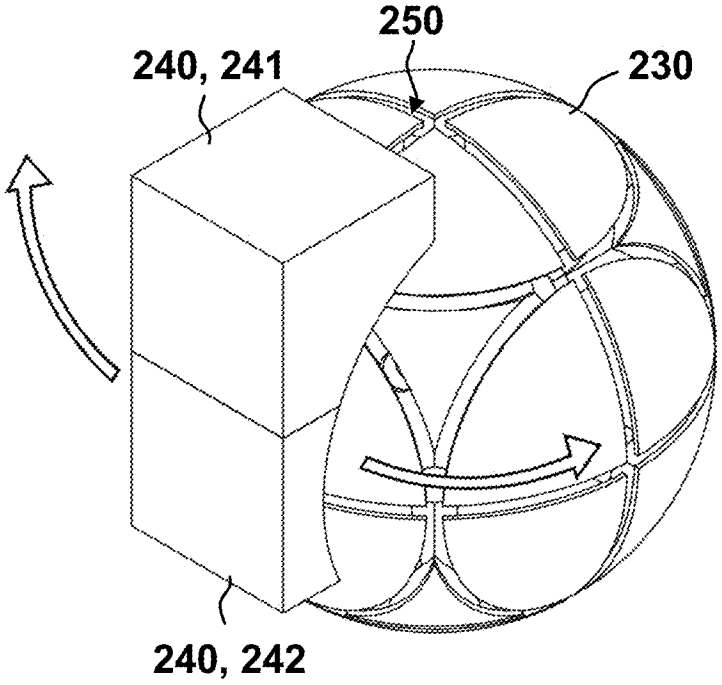
FIG. 7 depicts a perspective view of two cube components rotating around the outer shell, according to an embodiment of the disclosure.

FIG. 7 depicts a perspective view of two cube components 240 rotating around the outer shell 230, according to an embodiment of the disclosure. In particular, FIG. 7 depicts middle edge cube component 241 and middle center cube component 242 moving across guide channels 230. The disclosed combination puzzle may have twenty-six cube components in a 3×3 cube arrangement.

FIG. 8 depicts an exploded view of the outer shell 230, outer shell end 231, inner shell 220, and tumbler core 212, according to an embodiment of the disclosure. The outer shell is made of 4 separate parts. Two pieces 231 at the poles and two pieces 230 that form the two center hemispheres. The very center of the tumbler core 212 may be hollow in some embodiments to store the reward. The walls of the core may be thick, because that is where the springs for the tumbler pins are set. FIG. 4 shows this hollow core. In some embodiments, the tumbler core 212 is hollow and allows for the storage of items such as a reward for solving the puzzle. The storing of items provides the game device with an advantage as the game device incentives the solving of the puzzle by providing a reward. The reward may be any object that fits inside the hollow part of the core. In one embodiment, the reward may be a ring. In other embodiments, the reward may be a small figurine, stickers, a key, a USB with cryptocurrency stored on it, or the like.

Figure 9:
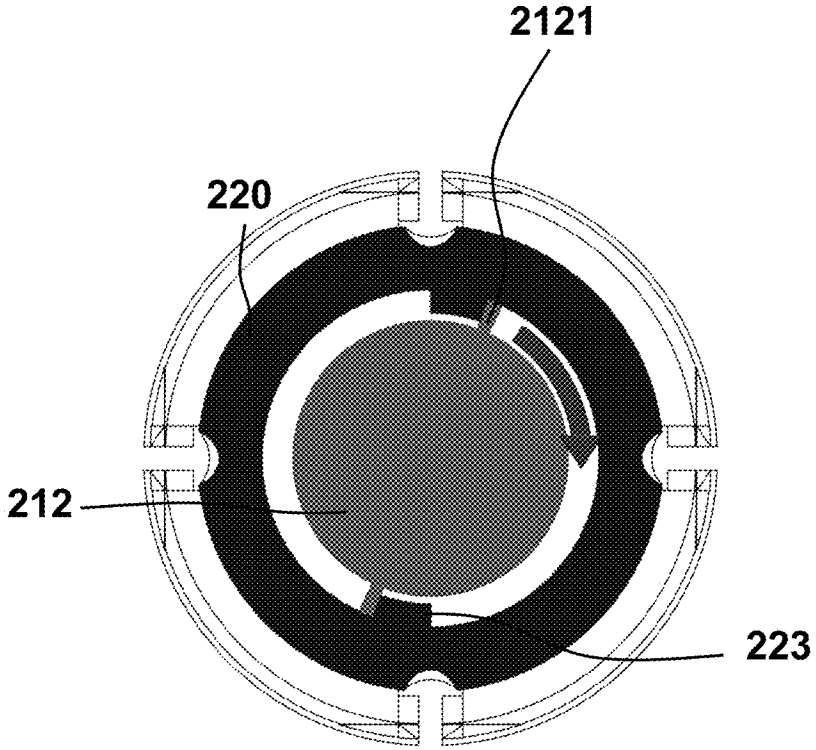
FIG. 9 shows a diagram of the tumbler core engaging the inner shell, according to an embodiment of the disclosure.

FIG. 9 shows a diagram of the tumbler core 212 engaging the inner shell 220, according to an embodiment of the disclosure. The tumbler core 212 may include a tumbler core tab 2121 that engages the inner shell inner tab 223 to prevent the inner shell 220 from rotating in a single direction.

Figure 10:
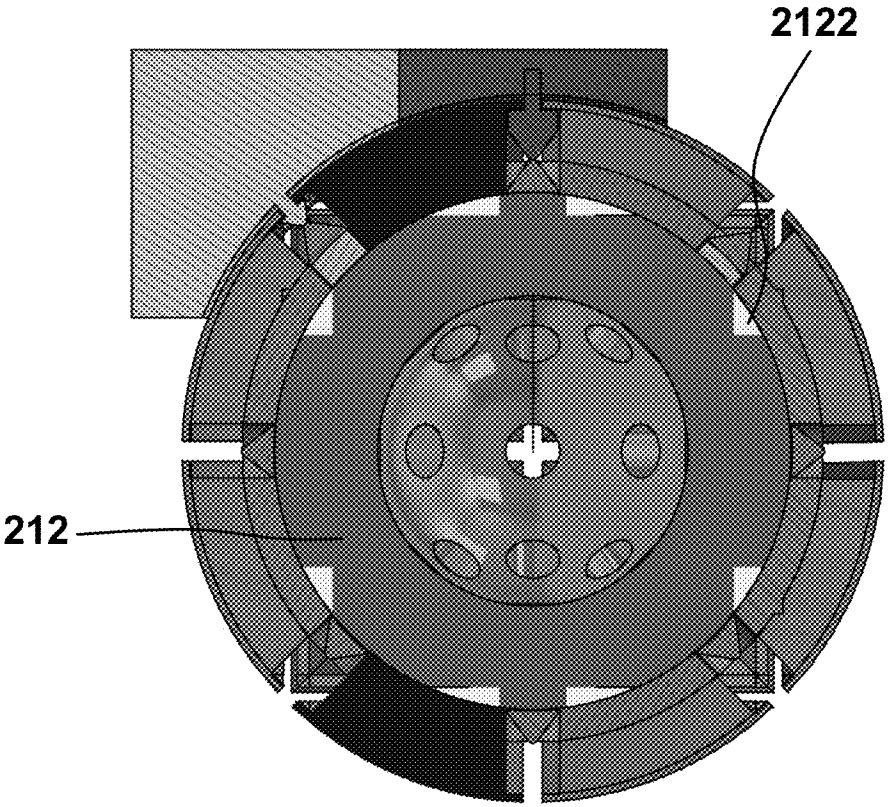
FIG. 10 shows a diagram of the tumbler core having exterior latches, according to an embodiment of the disclosure.

FIG. 10 shows a diagram of the tumbler core 212 having exterior latches 2122, according to an embodiment of the disclosure. The exterior latches 2122 may prevent the rotation of the tumbler core 212 in a different direction.

Figure 11B:
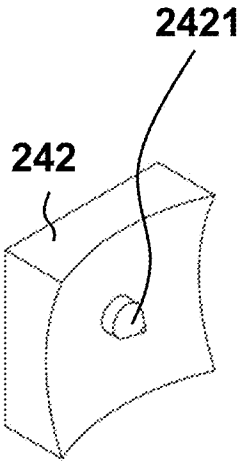
FIG. 11B depicts the pin of a center cube component, according to an embodiment of the disclosure.
Figure 11A:
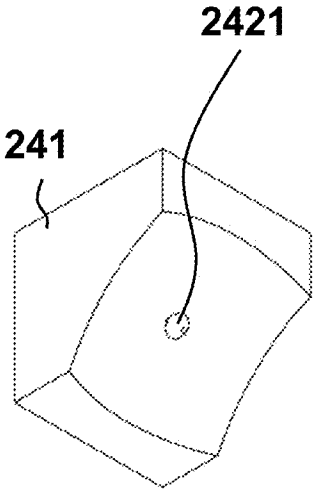
FIG. 11A depicts the pin of an edge cube component, according to an embodiment of the disclosure.

FIG. 11A depicts the pin 2411 of an edge cube component 241, according to an embodiment of the disclosure. Pin 2411 may be smaller than the center cube component pin 2421 as for the ridges along a key and the key pins inside a lock, the cube pins and upper tumbler pins need to be different in height. The combination of different heights for the tumbler pins and the cube pins will determine which one aligns the lower pin exactly inside the core and with the shear line. In some embodiments, the pins may have different lengths and not different sizes.

FIG. 11B depicts the pin 2421 of a center cube component 242, according to an embodiment of the disclosure. In some embodiments, pin 2421 may have an arrow peg shape to stay within a guide channel, such as in FIG. 5, 2401.

Figure 12B:
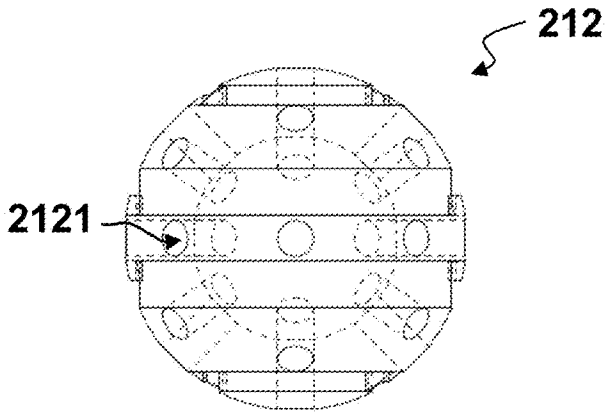
FIG. 12B shows another diagram of the tumbler core, according to an embodiment of the disclosure.
Figure 12D:
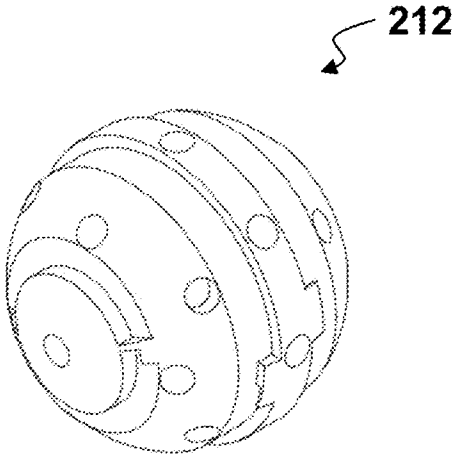
FIG. 12D depicts a perspective view of the tumbler core, according to an embodiment of the disclosure.
Figure 12A:
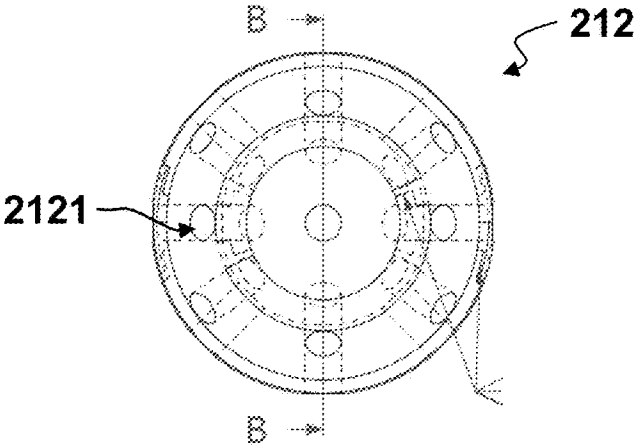
FIG. 12A shows a diagram of the tumbler core, according to an embodiment of the disclosure.

FIG. 12A shows a diagram of the tumbler core 212 having tumbler channels 2121, according to an embodiment of the disclosure. The dotted lines depict three dimensionally where the shafts for the springs and pins are located inside the core.

FIG. 12B shows another diagram of the tumbler core 212 having tumbler channels 2121, according to an embodiment of the disclosure.

Figure 12C:
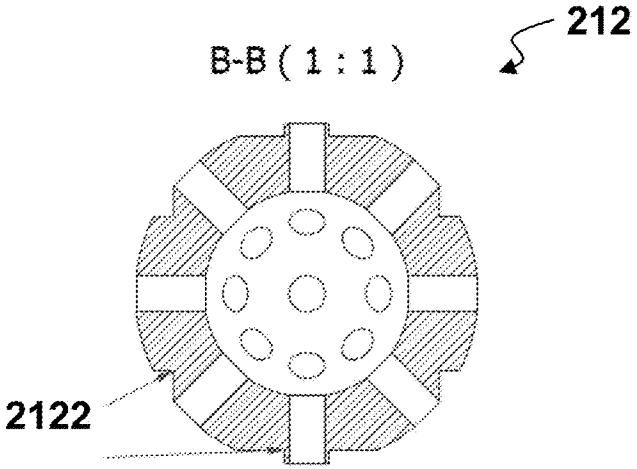
FIG. 12C shows a cross section of FIG. 10A along the line B-B of FIG. 12A, according to an embodiment of the disclosure.

FIG. 12C shows a cross section of FIG. 10A along the line B-B, according to an embodiment of the disclosure.

FIG. 12D depicts a perspective view of the tumbler core 212, according to an embodiment of the disclosure.

Figure 13A:
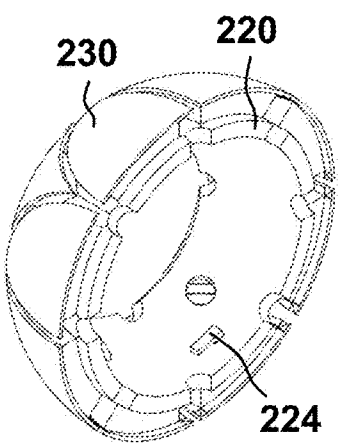
FIG. 13A depicts a perspective view of the outer shell and the inner shell, according to an embodiment of the disclosure.

FIG. 13A depicts a perspective view of the outer shell 230 housing the inner shell 220, according to an embodiment of the disclosure. In some embodiments, the inner shell 220 may have inner shell latches 224 to prevent the rotation of the tumbler core.

Figure 13B:
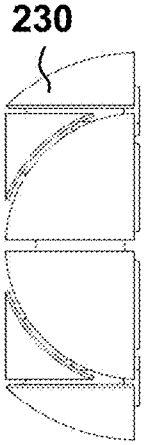
FIG. 13B depicts a side view of the outer shell, according to an embodiment of the disclosure.

FIG. 13B depicts a side view of the outer shell 230, according to an embodiment of the disclosure.

Figure 13C:
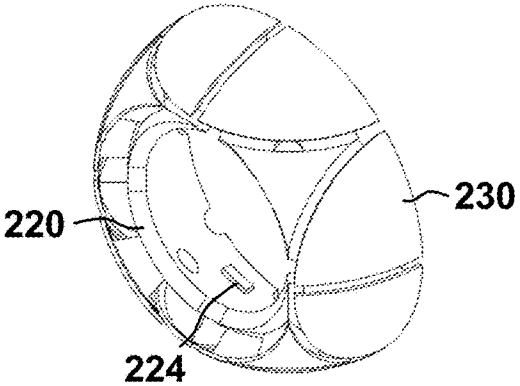
FIG. 13C depicts another perspective view of the outer shell and the inner shell, according to an embodiment of the disclosure.

FIG. 13C depicts another perspective view of the outer shell 230 and the inner shell 220 having an inner shell latches 224, according to an embodiment of the disclosure.

Figure 13D:
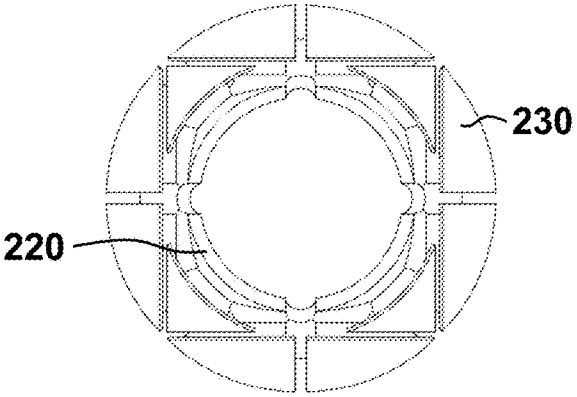
FIG. 13D depicts another side view of the outer shell and inner shell, according to an embodiment of the disclosure.

FIG. 13D depicts another side view of the outer shell 230 and inner shell 220, according to an embodiment of the disclosure.

Figure 14A:
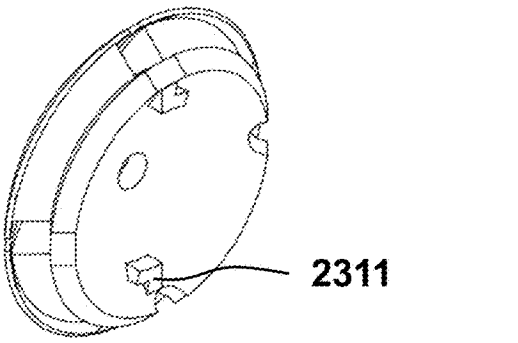
FIG. 14A depicts a perspective view of an outer shell end, according to an embodiment of the disclosure.

FIG. 14A depicts a perspective view of an outer shell end 231, according to an embodiment of the disclosure. The outer shell end 231 may have an outer shell end latch 2311 to attach to the outer shell 230.

Figure 14B:
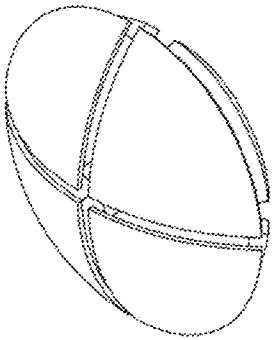
FIG. 14B depicts another perspective view of an outer shell end, according to an embodiment of the disclosure.

FIG. 14B depicts another perspective view of an outer shell end 231, according to an embodiment of the disclosure.

Figure 14C:
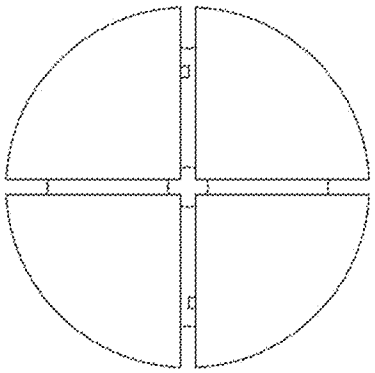
FIG. 14C depicts a side view of an outer shell end, according to an embodiment of the disclosure.

FIG. 14C depicts a side view of an outer shell end 231, according to an embodiment of the disclosure.

Figure 14D:
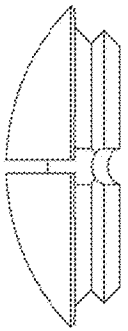
FIG. 14D depicts another side view of an outer shell end, according to an embodiment of the disclosure.

FIG. 14D depicts another side view of an outer shell end 231, according to an embodiment of the disclosure.

Figure 15:
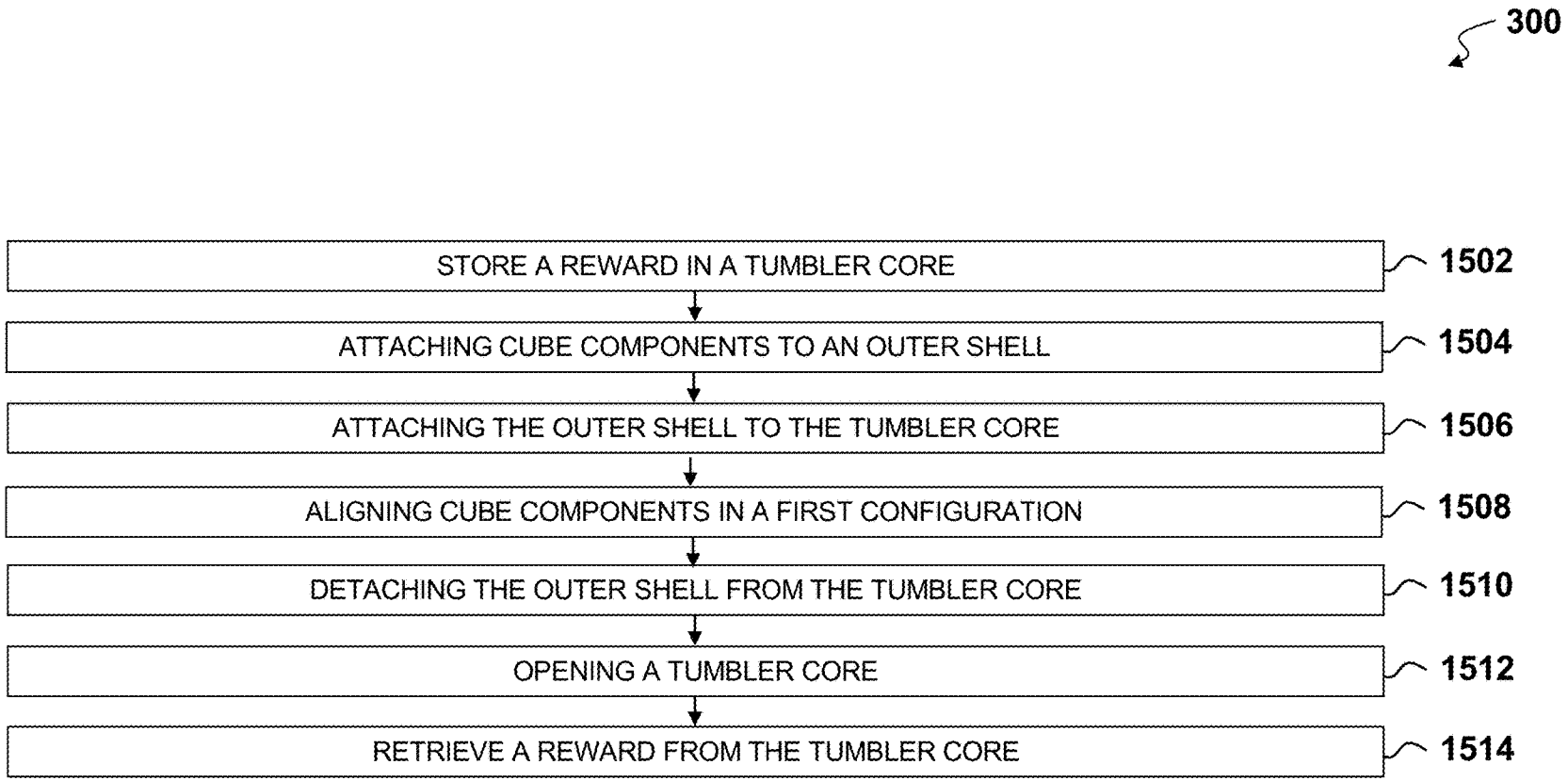
FIG. 15 is a flowchart of a method embodiment, according to an embodiment the disclosure.

FIG. 15 is a flowchart of a method 300 for solving a chess puzzle, according to an embodiment the disclosure. The method 300 may include storing a reward in a tumbler core (step 1502). The method 300 may then include attaching cube components to an outer shell (step 1504). A plurality of cube components may be attached to an outer shell defining a set of guide channels. The plurality of cube components may be configured to slide across the set of guide channels. Each cube component of the plurality of cube components may include a cube pin. Each cube may be disposed within a guide channel of the set of guide channels. Each cube pin may have a different length from each other cube pin.

The method 300 may then include attaching the outer shell to the tumbler core (step 1506). The outer shell may be attached to the tumbler core housed within the outer shell via a plurality of latches. The plurality of latches may connect the outer shell to the tumbler core at a shear line between the outer shell and the tumbler core.

The method may then include aligning the cube components in a first configuration (step 1508). The first configuration may be a solved configuration. In some embodiments, the first configuration may be where each face of a 3×3 combination puzzle cube has a checkmate of a King.

The method 300 may then include detaching the outer shell from the tumbler core (step 1510). The outer shell may be detached from the tumbler core housed within the outer shell via the plurality of latches. The plurality of latches may disconnect the outer shell from the tumbler core when all of the plurality of cube components are in their correct positions and/or in the first configuration.

The method 300 may then include opening the tumbler core (step 1512). The method 300 may then include retrieving a reward from the tumbler core (step 1514).

Figure 16:
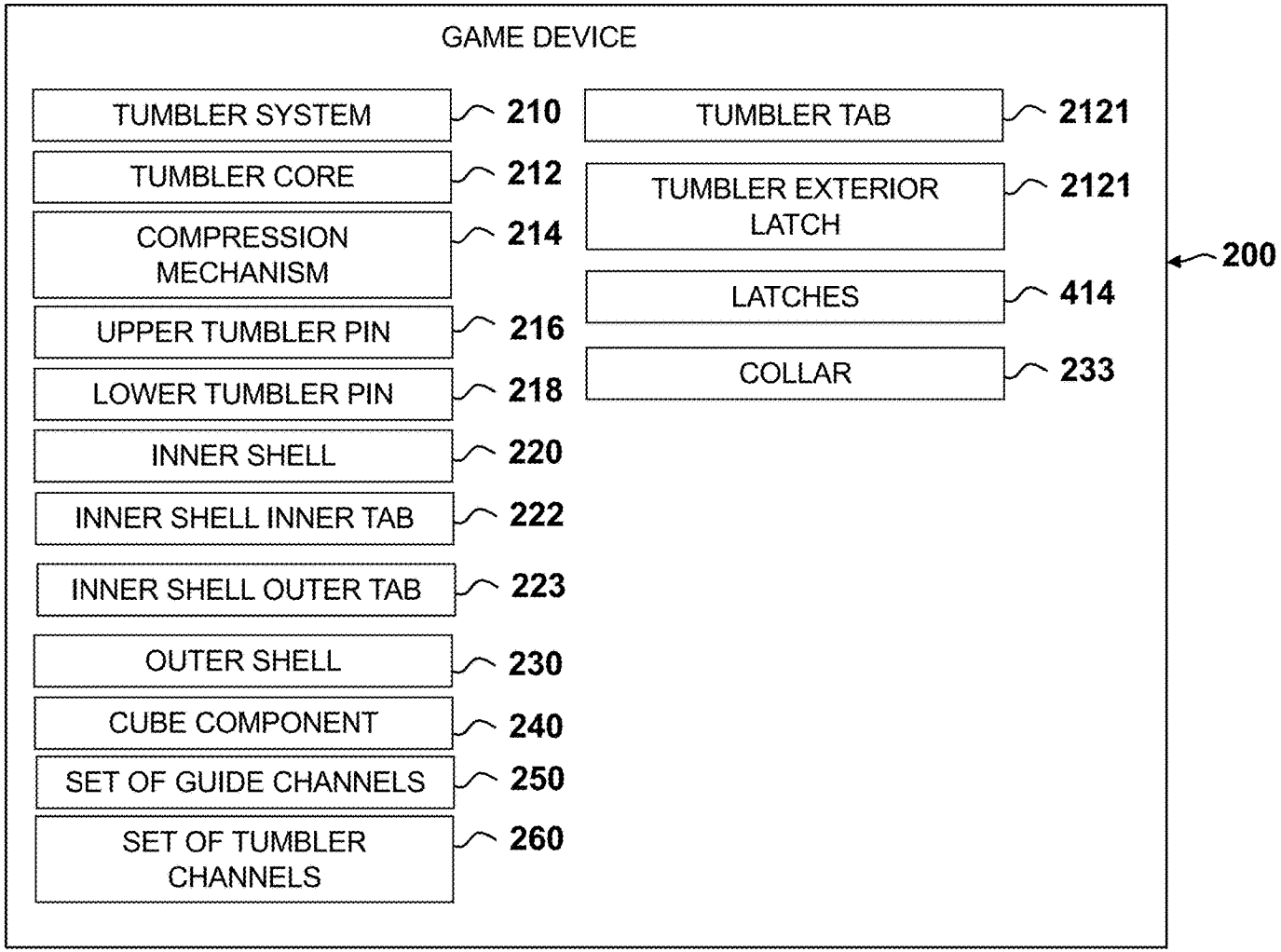
FIG. 16 is a high-level block chart of the game device.

FIG. 16 is a high-level block chart of the game device 200. The game device may include an outer shell 230 having a set of guide channels 250 for receiving cube components 240. An inner shell 220 may be rotationally locked to the outer shell by inner shell inner tab 223. The inner shell 220 may house a tumbler system 210. The tumbler system 210 may include an upper tumbler pin 216, a lower tumbler pin 218, a compression mechanism 214, and a tumbler core 212 defining a set of tumbler channels 260. The lower tumbler pin 218 is connected to the tumbler core 212 by the compression mechanism 214, and the lower tumbler pin 218, upper tumbler pin 216, and compression mechanism are disposed within a corresponding tumbler channel 260. The tumbler core 212 may have a tumbler tab 2121 and a tumbler exterior latch 2122 for rotationally locking the tumbler core 212 to the inner shell 220.

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further, it is intended that the scope of the present invention is herein disclosed by way of examples and should not be limited by the particular disclosed embodiments described above.

What is claimed is:

1. A game device comprising:

an outer shell defining a set of guide channels;

a tumbler core housed within the outer shell;

a plurality of latches connecting the outer shell to the tumbler core at a shear line between the outer shell and the tumbler core;

a plurality of cube components configured to slide across the set of guide channels, wherein each cube component of the plurality of cube components comprises a cube pin, wherein each cube pin is disposed within a guide channel of the set of guide channels, and wherein each cube pin has a different length from each other cube pin;

a plurality of pin tumbler mechanisms, wherein each pin tumbler mechanism comprises:

a spring inside a shaft;

a lower pin in contact with the spring;

an upper pin in contact with the lower pin, wherein the spring pushes the upper pin against a collar disposed proximate the guide channel such that at least a portion of the upper pin is disposed within the guide channel, wherein each upper pin has a different length from each other upper pin;

wherein the set of cube components are arranged to form a 3×3×3 cube;

wherein the cube pin of each cube component is configured to contact a portion of an upper pin of the plurality of pin tumbler mechanisms within the guide channel, wherein the cube pin opposes a spring of the plurality of pin tumbler mechanisms;

wherein when all of the plurality of cube components are in their correct positions each cube pin of each cube component opposes each respective upper pin such that each upper pin in contact with each lower pin is aligned with the shear line between the outer shell and the tumbler core; and wherein the plurality of latches disconnect the outer shell from the tumbler core when all of the plurality of cube components are in their correct positions.

2. The game device of claim 1, wherein four cube components on each side of the formed 3×3×3 cube have an imprinted chess piece.

3. The game device of claim 2, wherein the imprinted chess pieces comprise a King, a Rook, a Knight and a Bishop.

4. The game device of claim 3, wherein the correct positions involve a checkmate of the King on six sides of the formed 3×3×3 cube.

5. The game device of claim 1, wherein the tumbler core comprises:

one or more tumbler core tabs for rotationally locking the tumbler core to an inner shell in a single direction.

6. The game device of claim 5, wherein the inner shell comprises:

one or more inner shell tabs corresponding to the one or more tumbler core tabs.

7. The game device of claim 1, wherein the plurality of latches rotationally lock the tumbler core to the outer shell in a single direction.

8. The game device of claim 1, wherein the plurality of latches comprise preloaded springs.

9. The game device of claim 1, wherein the plurality of cube components comprise twenty-six cube components.

10. The game device of claim 9, wherein the plurality of pin tumbler mechanisms comprise twenty-six pin tumbler mechanisms.

11. A method comprising:

attaching a plurality of cube components to an outer shell defining a set of guide channels, wherein the plurality of cube components are configured to slide across the set of guide channels, wherein each cube component of the plurality of cube components comprises a cube pin, wherein each cube pin is disposed within a guide channel of the set of guide channels, and wherein each cube pin has a different length from each other cube pin;

attaching the outer shell to a tumbler core housed within the outer shell via a plurality of latches, wherein the plurality of latches connects the outer shell to the tumbler core at a shear line between the outer shell and the tumbler core;

detaching the outer shell from the tumbler core housed within the outer shell via the plurality of latches, wherein the plurality of latches disconnect the outer shell from the tumbler core when all of the plurality of cube components are in their correct positions.

12. The method of claim 11, further comprising:

retrieving a reward stored inside a hollow part of the tumbler core.

13. The method of claim 12, wherein the reward is at least one of: a small figurine, stickers, a key, and a USB with cryptocurrency stored on it.

14. The method of claim 11, wherein when all of the plurality of cube components are in their correct positions each cube pin of each cube component of the plurality of cube components opposes a respective upper pin of a plurality of pin tumbler mechanisms such that the respective upper pin is in contact with a lower pin and aligned with the shear line between the outer shell and the tumbler core.

15. The method of claim 14, wherein each pin tumbler mechanism of the plurality of pin tumbler mechanisms comprises:

a spring inside a shaft;

the lower pin in contact with the spring;

an upper pin in contact with the lower pin, wherein the spring pushes the upper pin against a collar disposed proximate the guide channel such that at least a portion of the upper pin is disposed within the guide channel, wherein each upper pin has a different length from each other upper pin.

16. The method of claim 15, wherein the cube pin of each cube component is configured to contact a portion of an upper pin of the plurality of pin tumbler mechanisms within the guide channel, wherein the cube pin opposes a spring of the plurality of pin tumbler mechanisms.

17. The method of claim 11, wherein the set of cube components are arranged to form a 3×3×3 cube.

18. The method of claim 11, wherein four cube components on each side of the formed 3×3×3 cube have an imprinted chess piece.

19. The method of claim 18, wherein the imprinted chess pieces comprises at least one of: a King, a Rook, a Knight and a Bishop.

20. The method of claim 17, wherein the correct positions involve a checkmate of a King on six sides of the formed 3×3×3 cube.

* * * * *